United States Patent [19]

Merchant

[11] 4,137,526

[45] Jan. 30, 1979

[54] ALARM ZONE DISABLING CONTROL CIRCUIT

[76] Inventor: Floyd S. Merchant, Box P25, R.D. Asbury, N.J. 08802

[21] Appl. No.: 782,443

[22] Filed: Mar. 29, 1977

[51] Int. Cl.[2] ..... G08B 29/00; G08B 25/00

[52] U.S. Cl. ..... 340/506; 340/514; 340/524; 340/541; 340/502; 340/508

[58] Field of Search ..... 340/409, 412, 213 R, 340/214, 213.1, 213.2, 415, 276, 506, 517, 520, 524, 502, 503, 514, 541

[56] References Cited

U.S. PATENT DOCUMENTS

| | | | |
|---|---|---|---|
| 3,525,988 | 8/1970 | Linder | 340/213 R |
| 3,581,300 | 5/1971 | Eloranta | 340/213.1 |
| 3,641,547 | 2/1972 | Reiss et al. | 340/409 |
| 3,683,362 | 8/1972 | Schwanenflugel | 340/213 Q |

*Primary Examiner*—Donald J. Yusko
*Assistant Examiner*—Donnie L. Crosland
*Attorney, Agent, or Firm*—McAulay, Fields, Fisher & Goldstein

[57] ABSTRACT

A control circuit for an intrusion or other event responsive alarm device, generates an operating signal for the alarm device in response to a signal provided by a sensor. A plurality of such control circuits are ganged together, each receiving sensor signals from different sensors. The alarm device is a single unit which is responsive to the operating signal from each control circuit. The alarm device, once activated into its alarm mode by an operating signal, provides an alarm output signal to the control circuits. The control circuit which is providing the operating signal becomes latched off in response to the alarm output signal and does not respond to further sensor signals. The alarm system continues to respond to operating signals initiated by sensors associated with the rest of the control circuits. When the cause of the alarm has been resolved, the latched off control circuit is reset.

15 Claims, 3 Drawing Figures

ALARM ZONE DISABLING CONTROL CIRCUIT

BACKGROUND OF THE INVENTION

Alarm systems such as intrusion alarms, fire alarms and similar systems will age and in time ofter develop intermittent problems generating false alarms. False alarms may also be generated by various physical conditions related to the type of alarm system and more particularly to the type of sensors used in the system. Wind rattling a door, for example, may generate a momentary "false" sensor signal in an intrusion alarm system and trigger the alarm signalling device. Such intermittent "false" signals, which generate false alarms, are the bane of all practical alarm systems. Under practical circumstances, it is sometimes difficult or impossible to immediately resolve the physical or electrical problem which is causing the false alarm to be triggered. The problem is compounded where sensor elements are wired together to provide a signal when any one sensor element is triggered or malfunctions.

A person notified by the same alarm for the third or fourth time, which alarm has previously been determined to be a false alarm, is likely to be less than diligent in responding to that alarm, especially if there are other pressing matters to be attended to. It would therefore be advantageous, especially in a situation where the cause of the first alarm cannot be determined or corrected immediately, to have a means for disconnecting or disabling that portion or zone of the alarm system wherein the problem has repeatedly occurred, while still maintaining the operability and therefore the protection afforded by the remainder of the alarm system.

It is an object of the present invention to provide a control circuit for an alarm system, which control circuit will become insensitive to sensor signals received from sensors connected to it as a result of an alarm output signal generated by an alarm which has been switched from standby to an alarm mode, in response to the sensor signals.

Another purpose of this invention is to provide an alarm system having multiple zones or channels which will automatically become insensitive to repeated sensor signals from a particular zone while still maintaining responsiveness to sensor signals from the remaining zones.

It is a related purpose of this invention to provide a signalling means to automatically indicate which zones are operative and which zones are insensitive to sensor signals.

It is a further object of this invention to provide means for resetting those portions of the circuit which have become insensitive to sensor signals, utilizing manual or other signal generating means which are not controlled by the operation of the alarm signal.

Another object of this invention is to provide means for selectively disabling a particular zone or zones without activating the alarm signalling device, for use when it is known that a sensor will otherwise signal a false alarm.

It is a still further object of this invention to provide an input circuit having two modes and, depending on the mode, which will accept an input or sensor signal from either a normally open switch or circuit or a normally closed switch or circuit sensor device.

It is a still further object of this invention to provide an alarm control system which can be operated in conjunction with a redundant zone system in which two, or more, separate sensors respond to the same event, such as the opening of a particular door or window. If one of the sensors becomes imoperative because of a malfunction and its associated control circuit is therefore latched out, the second or redundant sensor is still in operation and will provide warning if the event occurs.

It is still a further object of this invention to provide a multi-zone alarm system which gives automatic continuing alarm capabilities by employing an alarm signalling device which automatically resets to its stand-by mode after a predetermined period of alarm signalling. The alarm signalling device can then continue to respond to operating signals from the non-latched zones.

BRIEF DESCRIPTION

A plurality of sensors are employed. Each sensor responds to one or more events to provide a sensor signal. Each sensor may be composed of a group of wired together sensor elements in which the activation of any of the elements produces a sensor signal. A separate control circuit is used with each sensor. The term "sensor" will be used herein to refer to whatever sensor elements are associated with a single control circuit. The sensor may be composed of one or more sensor elements.

For example, each sensor may be a plurality of normally closed switches on doors or windows. The opening of a door or a window will open the associated switch and provide a sensor signal. A plurality of sensors are used to cover separate zones of an installation.

When a sensor is activated, the associated control circuit normally produces an operating signal which turns on an alarm device. The alarm device may include lights and a buzzer or bell as well as a signal to a remote location, such as a police station, to indicate that an unwarranted condition such as an intrusion exists. Only one alarm device is employed. When it is turned on, it provides an alarm output signal that is applied to each control circuit. The control circuit which is providing the operating signal is latched to an inoperative mode (it is latched off) by the coincidence of its own operating signal and the alarm output signal. In this fashion a false alarm due to a defective sensor is not repeated. Yet other sensor zones remain operative. A subsequent alarm will not be treated as if it were just another false alarm.

By providing two sensors with separate control circuits to respond to the same event a redundant zone system is achieved. Then, even though a sensor-control circuit zone is latched off, the redundant sensor-control circuit zone continues to provide alarm protection for the associated physical zone.

A latched-off zone can be reset manually with a reset switch.

The control circuit for each zone has two parallel normally off transistor switches, both of which when turned on provide a source of maintenance current for a silicon controlled rectifier (SCR) latching switch. One of the parallel switches is a sensor responsive switch which provides the operating signal for the alarm and simultaneously a source of maintenance current to the anode/cathode circuit of the SCR. The other parallel switch is termed herein a holding switch.

The triggering signal for the SCR is an alarm output signal which is a pulse having a predetermined duration and which is generated when the alarm device is signalling an alarm. Application of the triggering signal to the SCR, turns it on. In the activated zone, the maintenance current provided through the sensor responsive switch keeps the associated SCR turned on after the alarm output signal has terminated. In the other zones, there is no maintenance current to maintain the SCR on.

But the turning on of the SCR also causes the holding switch to turn on. Turning on the holding switch provides maintenance current for the SCR and simultaneously turns off and hold off the sensor responsive switch. The control circuit thereby becomes insensitive to further sensor signals and the SCR is maintained in a conducting state.

A capacitor connected across the SCR is charged to B+ and as long as it is so charged it prevents the holding switch from turning on. When the SCR turns on, the capacitor discharges across the SCR and after a time period greater than the duration of the alarm output signal, the capacitor discharges to a point which permits the holding switch to turn on. Thus in the non-active zones, the SCR turns off before the capacitor has discharged to that point. In this fashion the capacitor in each control circuit prevents all but the activated zone from latching out.

If the alarm device has been provided with an automatic reset to return it to its standby mode after a predetermined period of time, the non-latched zone or zones will be able to signal an alarm although the latched zone is no longer sensitive to sensor signals.

BRIEF DESCRIPTION OF THE DRAWINGS

FIG. 2 also shows a test circuit and a reset circuit.

In all these FIGS., minor circuit details are deleted for clarity. For example, a 10K ohm stabilization resistor is connected between the collector of the transistor Q12 and common. But it is not shown because it constitutes a detail of design that may or may not be needed as a function of transistor quality and operating parameters.

DETAILED DESCRIPTION OF THE PREFERRED EMBODIMENTS

Figure 1:
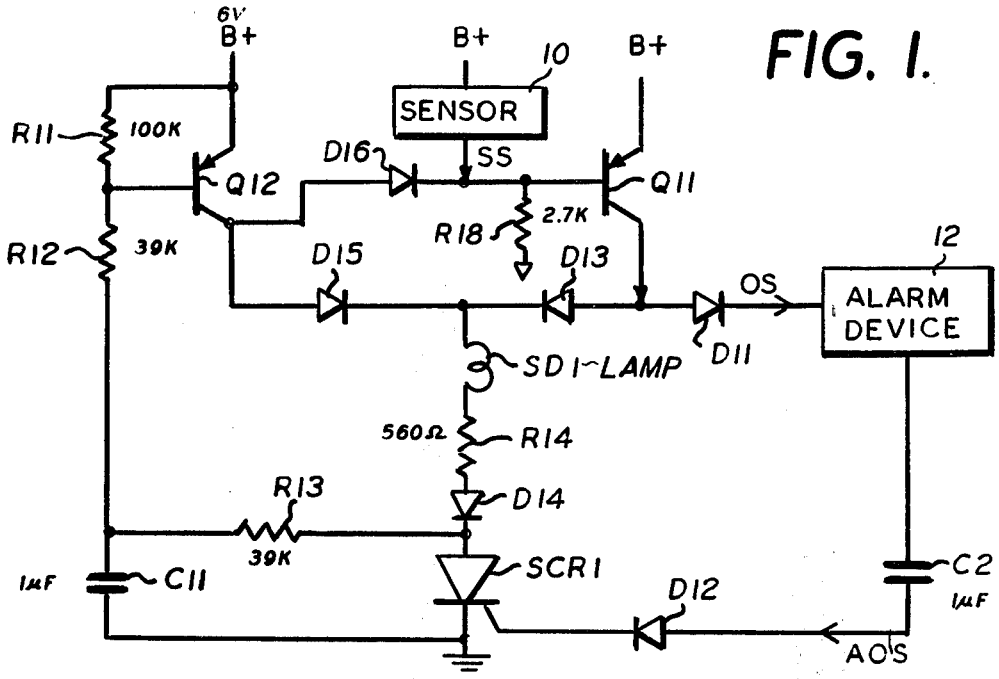
FIG. 1 is a schematic diagram showing a single control circuit, with its associated sensor, coupled to an alarm device.

As shown in FIG. 1, a sensor 10 provides a sensor signal SS, which is applied to the base of the 2N3638A silicon transistor Q11. The transistor Q11 operates as a switch to provide an operating signal OS to the alarm device 12. In the embodiment shown, the sensor 10 is one or more closed switches. When one of the closed switches opens, the base current of the transistor Q11 is completed from common through the 2.7 Kohm resistor R18; and the transistor Q11 turns on. Once the alarm device 12 is activated, it provides an alarm output signal AOS through isolating diode D12 to the trigger circuit of 2N5060 silicon control rectifier SCR1. The operating signal OS is also provided to the anode/cathode circuit of the SCR through isolating diodes D13 and D14. A signalling device SD1, most conveniently a light emitting source such as a light emitting diode (LED), is in series with the silicon controlled rectifier SCR1 to indicate that a current is flowing through SCR1.

A switch in the form of a second 2N3638A transistor Q12 is in parallel with transistor Q11.

A one microfarad capacitor C11 is normally charged to B+ through resistors R11 and R12. The capacitor C11 is connected across SCR1 through resistor R13 and will therefore partially discharge when SCR1 has been switched into a conducting state.

Resistors R11, R12 and R13 complete a biasing circuit for transistor Q12 through SCR1 to common. Once SCR1 has been switched into a conducting state, and after a predetermined period of time depending, for the most part, on the capacitance of capacitor C11 and the resistance of resistor R13, the capacitor C11 will discharge through SCR1 to below a threshold level (about 3 or 4 volts) and allow the transistor Q12 to be biased into a conducting state.

The switching of transistor Q12 to a conducting state provides a maintenance current circuit for SCR1 through isolating diode D15. The transistor Q12 simultaneously provides a signal, through the 1N634 isolating germanium diode D16, which removes the forward bias on transistor Q11, turns transistor Q11 off and prevents any sensor signal from turning on transistor Q11. Once transistor Q12 has been turned on then as long as a maintenance current flows through SCR1, the transistor Q12 will be maintained in a conducting state and consequently the transistor Q11 will be maintained in a nonconducting state.

The signalling device SD1 lights up under this operating condition to visually indicate that the maintenance current is passing through SCR1 and therefore that the control circuit is being maintained insensitive to a sensor 10 signal.

The alarm device 12 has a power switch (not shown) which is used to turn the alarm device 12 off during hours where authorized traffic would otherwise actuate a sensor and turn on an alarm.

Figure 2:
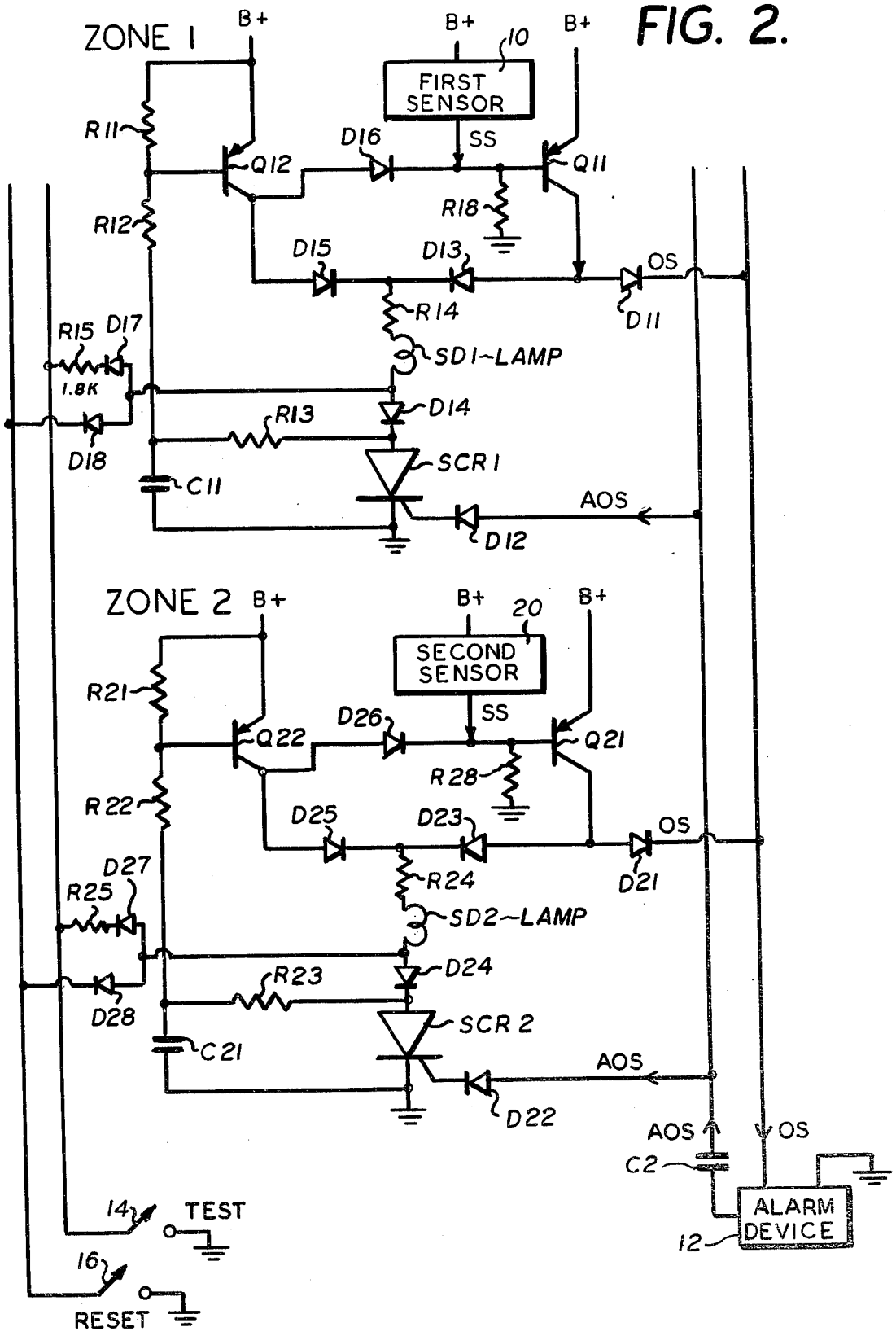
FIG. 2 is a schematic diagram showing two separately operable zones coupled to the alarm device.

FIG. 2 shows two control circuits ganged together. Parallel reference numbers are used where applicable.

A reset circuit, deleted from FIG. 1 for clarity is shown in FIG. 2. The reset circuit acts to reduce the maintenance current through whichever SCRs are on to a level below that which will maintain the SCR in a conducting state, by bypassing the maintenance current to common.

Isolating diode D14 prevents capacitor C11 from discharging through the reset circuit during the reset operation. Additionally, because of the possibility that the voltage drop across diode D18 may be sufficient to sustain a maintenance current through SCR1, diode D14 is also important in providing additional voltage drop to insure the turning off of the SCR.

A 560 ohm resistor R14, shown in series with the signalling device SD1 may be required to protect SCR1 and the signalling device SD1 by limiting the current through SCR1, especially if an LED is employed.

The present invention is most useful in alarm systems where there are a plurality of sensors and where it is desired to maintain at least a portion of the system responsive to the sensors, even through other portions of the system are disabled. FIG. 2 is a schematic diagram showing additional circuit details and the manner in which several of the FIG. 1 circuits are ganged together to actuate the same alarm device 12 while maintaining their independence from one another with respect to the sensors separately connected to each. FIG. 2 shows two circuits similar to FIG. 1, ganged together to form a two channel or zone system. Any number of zones can be analogously ganged together. The elements in zone 1 are numbered with numerals commencing with 1, those in zone 2 are numbered with numerals commencing with 2.

The embodiment shown in FIG. 2 can be adapted to a redundant zone system by locating the second sensor system to respond to the same events to which the first sensor system responds. This provides the possibility of two sets of signals from the same area. The triggering of both zones at the same time indicates that the signal is caused by a "true" rather than a "false" alarm. Additionally, if one of the zones is disabled, the other zone may remain active to provide protection in the otherwise unprotected area.

The embodiment shown in FIG. 2 is also especially useful when employed with an alarm signalling device capable of resetting itself to a standby mode after a predetermined alarm signalling period. This will allow the operable zone or zones to signal an alarm even though one or more zones has been latched off. Such an arrangement is particularly useful for protection in remote locations. A partial system will remain operative even though other parts have become inoperative, without someone actually resetting the circuit. Thus some protection is afforded until all the zones have been latched off.

FIG. 2 illustrates a reset circuit and a test circuit.

The reset circuit is used to unlatch all latched zones. Reset switch 16 is a spring loaded momentary switch. When the switch 16 is closed, it brings the anode of each SCR essentially to common thereby starving the SCR and turning it off. As a consequence, the transistor Q12 turns off because its base emitter circuit is opened. Turning off the transistor Q12 returns control of the transistor Q11 to the first sensor. A similar reset occurs for each zone that may have been latched.

The test switch 14 is also a momentary switch. It is used before the alarm device is turned on to determine if an alarm will go off when the alarm device is turned on. Pressing the test switch 14 will turn on the light emitting diode SD in any zone where a sensor signal SS is present. This is useful to preview the status of all sensors and secure the premises before turning on the alarm system. The resistors R15, R25 prevents unlatching any latched SCR so that the status of a latched zone will not be disturbed by the preview operation.

Diodes D17, D18, D27, D28 isolate the zones or channels from one another.

The diode D14 performs two functions. First, as to unlatched zones. When either the test switch 14 or reset switch 16 is actuated, the diode D14 prevents the capacitor C11 from discharging and assures that the base emitter circuit for the transistor Q12 remains open. Thus, the transistor Q12 is kept from turning on. Second, as to the latched zone or zones. When the reset switch 16 is closed, the voltage drop across the diode D18 may be sufficient to sustain a maintenance current through the SCR. But the diode D14 assures enough of an additional voltage drop to bring the anode of the SCR to a turn off point.

In order to insure against the accidental turning on of the alarm signal due to the characteristics of the components within the circuit, it has been found preferable that both transistor Q12 and diode D16 be low voltage saturation devices. In particular, diode D16 should have a forward turn on voltage of less than one quarter volt and transistor Q12, a saturation voltage also of less than one-quarter volt. The transistor Q11 must be a silicon device. The diode D16 should be a germanium device or one exhibiting similar low forward voltage characteristics.

Capacitor C13 and resistor R17 are wired across the SCR gate/cathode and the capacitor C14 wired across its anode/cathode, to provide stability in the circuit by preventing the accidental triggering of the SCR. These elements are therefore preferable to maintain the stability of the circuit under practical circumstances of use, in view of the nature of usually available silicon controlled rectifier devices.

The capacitor C2 performs the important function of responding to the turning on of the normally d.c. alarm output signal to immediately provide a single pulse input to the gate of the SCR as the triggering signal for the SCR. It is important that the triggering signal for the SCR be a pulse so that in the non-activated zones, the capacitor C11 maintains enough charge to prevent the holding transistor Q12 from turning on. Broadly, the latching signal to the SCR must be a pulse of a predetermined limited duration in order to prevent all of the non-activated zones from becoming latched. Specifically, the duration of the triggering pulse to the gate of the SCR must be less than the time period for discharge of the capacitor C11 to below the threshold necessary to maintain transistor Q12 in a nonconducting state.

The alarm device 12 frequently produces undesirable transients, pulses and interference, all on top of a normal d.c. output. These undesirable effects are generally caused by various sounding devices used in the alarm device 12. The network composed of the capacitor C2, resistor R2 and diode D2 is important in order to surpress most of these undesirable constituents and to prevent them from being applied to the gate of the SCR.

The diode D3 is employed for similar reason. There are uncontrolled inputs likely to be applied to this system through the circuity that includes the disable switch SW1. The diode D3, together with the resistor R2 and capacitor C2 accordingly serves to rectify and prevent such signals from passing through to the gate of the SCRs.

The disable switch SW1 (see FIG. 3) is employed to permit manually disabling all those zones in which there is a sensor 10 input SS. Closing of the switch SW1 applies a d.c. voltage which is transmitted to the gate of each SCR as a pulse through the capacitor C2 and thus will latch any zone where the transistor Q11 has been switched on.

Figure 3:
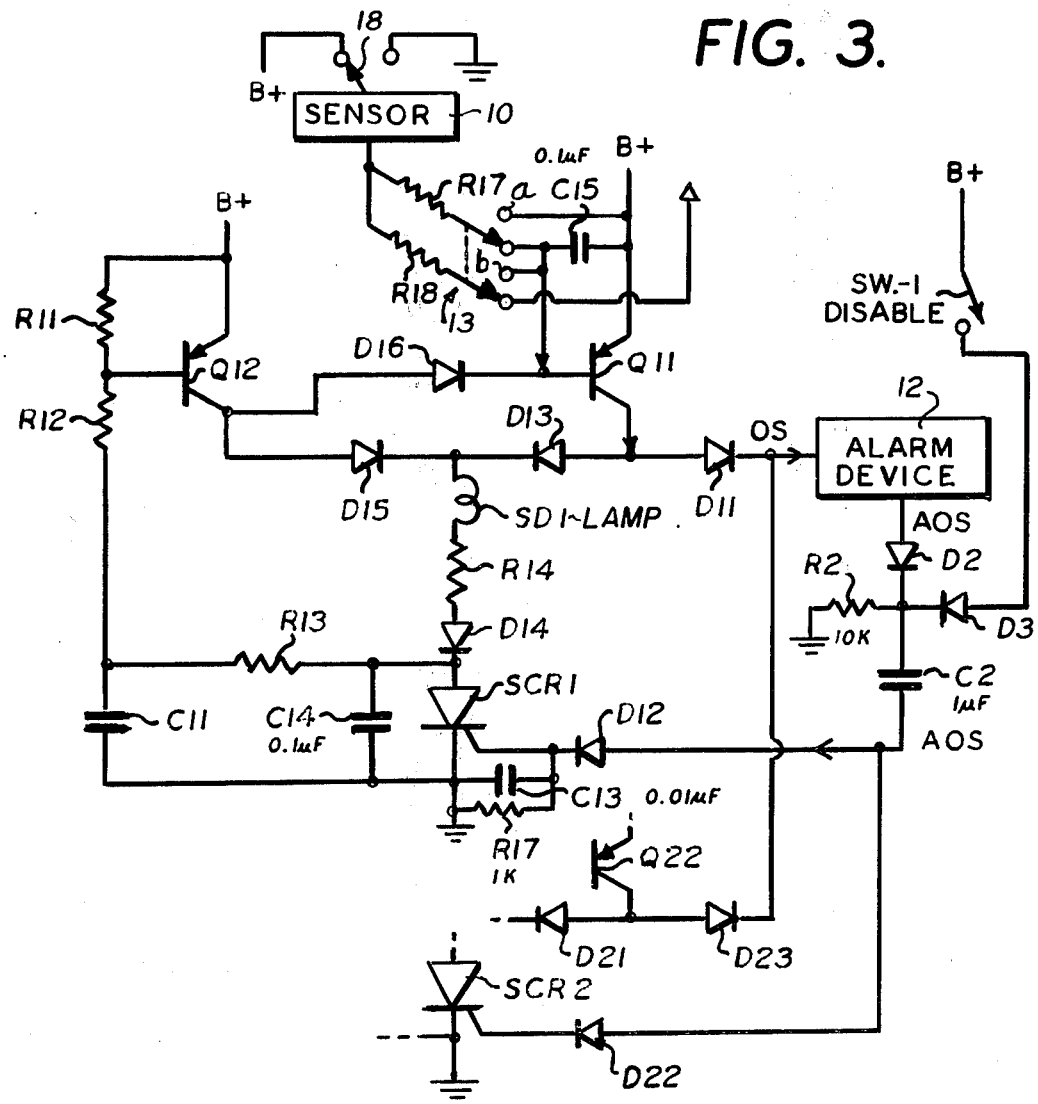
FIG. 3 is a schematic diagram similar to that of FIG. 1 showing additional details including an input circuit and a zone disabling circuit.

FIG. 3 shows a schematic for zone 1 and partial schematic showing the interconnection of zone 1 with zone 2, similar to that shown in FIG. 2. A number of additional details, some dealing with the practical aspects of the circuits, have been shown in FIG. 3.

A disable circuit comprising switch SW1 and resistor R2 allows disabling a particular zone manually and without setting off the alarm device 12. As can be seen in FIG. 3, this circuit provides an alternative trigger signal for the SCR. To accomplish this, the switch SW1 connects B+ through diode D3, to the trigger circuit of silicon controlled rectifier SCR1. This circuit is useful in those situations where, for some reason, it is not possible to reset a sensor. Under practical circumstances for an intrusion alarm, this problem may arise where, for instance, a door cannot be properly closed or a portion of the circuit has been destroyed. Turning on the alarm will, in that instance set off a signal from the alarm device. By providing an "artificial" signal to the gate of the silicon controlled rectifier SCR, the associated control circuit will be triggered into a latched condition without requiring that the alarm device be turned on. The alarm device can thereafter be turned on into its standby mode without being activated by the known problem.

Also shown in FIG. 3 are details of a possible sensor signal input circuit. Shown is a DPDT switch 13 wired with a 560 ohm resistor R17 and a 2.7K ohm resistor R18. This input circuit provides for the use of either normally open or normally closed sensor circuits.

The switch 13 connections as shown in FIG. 3 are representative of the situation discussed in connection with FIGS. 1 and 2, specifically a situation in which the sensor unit 10 constitutes one or more normally closed sensors. It should be noted that the base of the transistor Q11 is connected to common through the resistors R17 and R18 when the switch 13 is as shown in FIG. 3. Then the normally closed sensors are used and when one or more open, the base current for the transistor Q11 is supplied from common through the two resistors R18 and R17, thereby turning transistor Q11 on.

When normally open sensors are employed in the sensor arrangement 10, then the resistor R17 is switched to the terminal a and the resistor R17 is switched to the terminal b. At the same time, the sensor configuration 10 is connected to common rather than to B+ and this is figuratively shown in FIG. 3 by virture of the switch 18 even though such a switch would not exist, because in most circumstances the sensors are wired directly to the desired current source. When normally open sensors are employed, they are wired in parallel, by contrast to the series wiring of the normally closed sensors in the embodiment described above. Upon the closing of one of the normally open sensors elements, base current is supplied to the transistor Q11 from common through resistor R18 and is sufficient to turn on the transistor Q11.

The capacitor C15 performs a radio frequency filter function. Alarm sensors normally employ a substantial conductive material and act as radio frequency antennas. In FIG. 3, the capacitor C15 together with R17 operates to filter out the radio frequency when the normally conducting sensors are used and, when normally open sensors are used capacitor C15 together with the resistor R18 operates to filter out radio frequency. The filtering out of radio frequency aids in preventing accidentally turning on any active zone which would cause a false alarm.

The capacitor C13 and resistor R17 are wired across the SCR gate and cathode. The capacitor C14 is wired across the SCR anode and cathode. These three elements provide stability in the circuit and prevent accidental triggering of the SCR. The resistor R17 is particularly important because it prevents the SCR from having too low a maintenance current. Both of the capacitors C13 and C14 provide filters for RF and, more importantly, spikes and sudden pulses that may occur in the circuity.

Diode D16 performs the important function of blocking current from getting into the collector circuit of transistor Q12 from the base circuit of transistor Q11 when transistor Q12 is off. This prevents transistor Q11 from falsely turning on in open sensor circuit mode. This also preserves the function of Q12 by isolating it from the base emitter junction of Q11.

In summary, the various features described permit continued operation of unaffected zones where there has been either an intermittent sensor signal or a continuous sensor signal from one zone. The occurance at that zone of either a false alarm or a real alarm will cause that zone to become automatically latched out. Yet all other zones, including partially or fully redundant zones, will remain active and will continue to provide alarm protection.

What is claimed is:

1. A control circuit for an alarm system, the system having a sensor to provide a sensor signal, an alarm device responsive to an operating signal to provide an alarm output signal and to signal an alarm, the control device comprising:

a normally off sensor responsive switch having an on state and an off state, a normally off holding switch having an on state and an off state, a normally off latching switch having an on state and an off state, said sensor responsive switch switching into its on state in response to said sensor signal when said holding switch is in its off state to provide an operating signal, means responsive to said alarm output signal to provide a latch initiating signal to said latching switch, said latching initiating signal having a predetermined duration, said latching switch switching into its on state in response to said latch initiating signal when said sensor responsive switch is in its on state, said latching switch holding its on state in response to said on state of said sensor responsive switch and/or said on state of said holding switch, said holding switch switching into its on state in response to the on state of said latching switch, and delay means coupled to said holding switch and responsive to the switching on of said latching switch to delay said on state of said holding switch a predetermined time period after said latching switch switches into its on state, said predetermined time period being greater than said predetermined duration of said latch initiating signal, said sensor responsive switch switching into its off state in response to the on state of said holding switch regardless of the presence of the sensor signal.

2. The control circuit of claim 1 further comprising:

operator actuated switch means to switch said latching means into its off state, said holding switch switching into its off state in response to the off state of said latching switch.

3. The control circuit of claim 1 wherein:

said delay means includes a capacitor coupled to said latching switch and to said holding switch, said capacitor having a first charge state and second charge state, said first charge state of said capacitor maintaining said holding switch in its off state regardless of the state of said latching switch, said capacitor switching into its second charge state in response to said on state of said latching switch.

4. The control circuit of claim 2 wherein:

said delay means includes a capacitor coupled to said latching switch and to said holding switch, said capacitor having a first charge state and a second charge state, said first charge state of said capacitor maintaining said holding switch in its off state regardless of the state of said latching switch, said capacitor switching into its second charge state in response to said on state of said latching switch.

5. The control circuit of claim 1 further comprising: a signalling device operably coupled to said latching switch to produce a signal when said latching switch is in its on state.

6. The control circuit of claim 3 further comprising: a signalling device operably coupled to said latching switch to produce a signal when said latching switch is in its on state.

7. The control circuit of claim 2 wherein: said latching switch comprises a silicon controlled rectifier and said operator actuated switch means when activated bypasses current from said silicon controlled rectifier to reduce current flow through said rectifier to below the maintenance level.

8. The control circuit of claim 3 wherein:

said sensor responsive switch and said holding switch comprise a first and second transistor respectively and said latching switch comprises a silicon controlled rectifier, the collector of said second transistor and said sensor signal both being connected to the base of said first transistor whereby said second transistor may be operable to turn off said first transistor;

said collector of said second transistor being further connected to common through said silicon controlled rectifier to provide maintenance current for said latching switch when said second transistor is switched into its on state, the base of said second transistor being connected to common through said silicon controlled rectifier to bias said second transistor into its on state when said silicon controlled rectifier is turned on, said capacitor, in said first charge state, opposing the biasing of said second transistor into its on state, the collector of first transistor being connected to common through said silicon controlled rectifier to provide maintenance current for said latching switch when said first transistor is switched into its on state, the triggering of said silicon controlled rectifier switching the state of said capacitor to said second charge state to permit the biasing of said second transistor into its on state and consequently switching said first transistor into its off state.

9. The control circuit of claim 1 wherein said means responsive to said alarm output signal includes a capacitor to provide a single pulse in response to the leading edge of said alarm output signal.

10. The control circuit of claim 3 wherein said means responsive to said alarm output signal includes a capacitor to provide a single pulse in response to the leading edge of said alarm output signal.

11. The control circuit of claim 8 wherein said means responsive to said alarm output signal includes a capacitor to provide a single pusle in response to the leading edge of said alarm output signal.

12. An alarm system comprising:

at least first and second sensors to provide first and second sensor signals respectively, at least first and second sensor responsive switches, each having an on state and an off state, and providing first and second operating signals respectively in response to said first and second sensor signals respectively, an alarm device responsive to either of said operating signals to provide an alarm output signal and to signal an alarm, means responsive to said alarm output signal to provide a latch initiating signal having a predetermined duration, at least first and second latching switches, each having an on state and an off state and each coupled to switch into its on state in response to said latch initiating signal when the corresponding one of said sensor responsive switches is in its on state, at least first and second holding switches, each having an on state and an off state, each of said holding switches switching into its on state in response to the switching on of the corresponding one of said latching switches, each of said latching switch is being switchable into its on state in response to said latch initiating signal when said holding switch is in its on state, delay means coupled to said holding switch and responsive to the turning on of said latching switch to delay the turning on of said holding switch a predetermined time period greater than said predetermined duration of said latch initiating signal.

13. The alarm system of claim 12 wherein said first and second sensors are responsive to the same event.

14. The alarm system of claim 12 wherein said first and second sensors are responsive to separate events.

15. The alarm system of claim 12 wherein said first and second sensors are each composed of a plurality of sensor elements, one of said sensor elements of said first sensor and one of said sensors elements of said second sensor being responsive to the same event.

* * * * *